US006477117B1

(12) United States Patent
Narayanaswami et al.

(10) Patent No.: US 6,477,117 B1
(45) Date of Patent: Nov. 5, 2002

(54) ALARM INTERFACE FOR A SMART WATCH

(75) Inventors: Chandrasekhar Narayanaswami, Wilton, CT (US); Mandayam T. Raghunath, Poughkeepsie, NY (US)

(73) Assignee: International Business Machines Corporation, Armonk, NY (US)

( * ) Notice: Subject to any disclaimer, the term of this patent is extended or adjusted under 35 U.S.C. 154(b) by 26 days.

(21) Appl. No.: 09/608,043

(22) Filed: Jun. 30, 2000

(51) Int. Cl.[7] ..... G04C 21/16; G04G 13/02

(52) U.S. Cl. ..... 368/251; 368/244; 368/246; 368/248; 368/224; 368/243

(58) Field of Search ..... 368/10, 109, 243, 368/244, 246, 247, 248, 250, 251, 262, 263, 267

(56) References Cited

U.S. PATENT DOCUMENTS 4,908,784 A * 3/1990 Box et al. ..... 368/119
5,602,566 A * 2/1997 Motosyuku et al. ..... 345/123
5,701,446 A * 12/1997 Abali et al. ..... 713/400
5,825,353 A * 10/1998 Will ..... 368/10
5,940,076 A * 8/1999 Sommers et al. ..... 345/339
6,271,835 B1 * 8/2001 Hoeksman ..... 345/168

OTHER PUBLICATIONS

PagerWirter 2000x User's Guide, Motorla, Inc., 1999.*
"The World's Smallest PDA Computer Watch", Hammacher Schlemmer Mid Summer 2000 Catalog, p. 3. Mid Summer 2000.

* cited by examiner

*Primary Examiner*—David S. Martin
*Assistant Examiner*—Jeanne-Marguerite Goodwin
(74) *Attorney, Agent, or Firm*—Scully, Scott, Murphy & Presser; Gail H. Zarick, Esq.

(57) ABSTRACT

A wearable mobile computing device/appliance (a wrist watch) with a high resolution display that is capable of wirelessly accessing information from a network and a variety of other devices. The mobile computing device/appliance includes a user interface that is used to efficiently interact with alarms and notifications on the watch.

36 Claims, 9 Drawing Sheets

ALARM INTERFACE FOR A SMART WATCH

BACKGROUND OF THE INVENTION

1. Field of the Invention

This invention relates generally to mobile computing devices such as personal digital assistants (PDAs), cellular phones, pagers, and the like, and more specifically, to a wearable device/appliance (a wrist watch) capable of wirelessly accessing information and equipped with an interactive user interface that is used to efficiently interact with alarms and notifications on the watch.

2. Discussion of the Prior Art

Computing, mobile and wireless communications technologies have been rapidly advancing—culminating in a variety of powerful user friendly devices such as personal digital assistants (PDAs), cellular phones, pagers, etc. Today, it is possible to purchase handheld PDA's, e.g., palmtops such as the Palm Pilot®, that employ wireless communication devices and that combines computing, telephone/fax, and networking features. A typical PDA may function as a cellular phone, fax sender, and personal organizer and are pen-based, requiring a stylus for text entry. As such, these device incorporate handwriting recognition features and may even employ voice recognition technologies that react to voice input. Small devices such as the RIM 950 and the Motorola PageWriter 2000 pager use a small keyboard for input.

Today, the industry is striving to provide advancements by providing increased PC desktop-like functionality while both decreasing size and power requirements. More recently there have been attempts to incorporate some of the capabilities of the above devices into wrist watches. However, today, only special wearable watch devices are available that, besides time keeping functions, may possess a compass, or a Global Positioning System (GPS), or barometer, heart rate monitor, Personal Handy System (PHS) phone, pager, etc. There are shortcomings in these existing special function watches in that most of them are bulky, are mostly unconnected to the Internet or other PC/network devices, have limited battery life, and, are difficult to use. These currently available special function wrist watches additionally have user interfaces that are quite limited in what they can display. For example, in the context of setting time in digital watches, currently, the user is only enabled to set the hour and minute independently, with time only advancing in one direction. Furthermore, most of them have a 6 to 8 seven segment LED or LCDs which can be used to display 6 or 8 digits/letters, and have a small number of indicators that can display AM/PM, Alarm on/off, etc. only at fixed locations within the display. A few watches are currently appearing on the market that have slightly richer display characteristics. Regardless, these various shortcomings have to be solved, otherwise there is no compelling reason for these watches to become popular. The design of a wrist watch for mobile computing applications offers a significant challenge because the watch is a small device.

That is, both fitting components and power supplies such as batteries into such a small volume and given the limited screen size of watches pose limitations that have be overcome. Solving these issues is worthy because the watch is an attractive form as 1) it is one of the few devices that a very large fraction of the population is already accustomed to worldwide, 2) is accessible almost all the time, and, 3) is hard to lose.

It would thus be highly desirable to provide a wearable device/appliance (a wrist watch) capable of wirelessly accessing information and equipped with an interactive user interface and high resolution display for providing a variety of desktop PC-like functions.

It would additionally be highly desirable to provide a wearable device/appliance (a wrist watch) capable of providing time-keeping/alarm functions and equipped with an interactive user interface for enabling the setting of the various time-keeping/alarm functions in a manner requiring minimal effort and concentration from the user.

SUMMARY OF THE INVENTION

It is an object of the present invention to provide a wearable It device/appliance (a wrist watch) capable of wirelessly accessing information and equipped with an interactive user interface and high resolution display for providing a variety of desktop PC-like functions.

It is another object of the present invention to provide a wearable device/appliance (a wrist watch) capable of providing time-keeping/alarm functions and equipped with an interactive user interface for enabling the setting of the various time-keeping/alarm functions in a manner requiring minimal effort and concentration from the user.

According to the invention, there is provided a system and method for efficiently activating and deactivating alarm functions via a user interface provided in a wearable appliance having a display for displaying textual or graphical content and including a touch sensitive panel for detecting physical user interaction. The method comprises setting an alarm via minute and hour hand display indicators in response to scroll events generated by manipulating a scroll device; determining a time setting of a next set alarm and providing an alarm indication at the set time; and, detecting a first user interaction with the touch sensitive panel to deactivate said alarm indication, whereby minimal user interaction is required to achieve a desired time set and alarm deactivation.

Preferably, an alarm comprises one of two types: an absolute alarm and, a relative alarm. The absolute alarm is set to activate at a daily frequency, and the relative alarm is set for activation at a predefined time relative to a current time and subsequently thereafter. The system is further capable of detecting a second user interaction with the wearable-appliance within a pre-determined time interval, the second interaction proactively enabling one of: automatic snooze-alarm setting; cancellation of the alarm, and, automatic re-setting of the alarm for the next day.

Further advantages and features include the provision of a mechanism for enabling input of a text message for association with a set alarm, the activation of a set alarm at the set time including simultaneously displaying the associated text message via the user interface, and, the provision of a mechanism for setting a quiet alarm interval defining an interval of time in which a set time alarm is not to be activated.

BRIEF DESCRIPTION OF THE DRAWINGS

Further features, aspects and advantages of the apparatus and methods of the present invention will become better understood with regard to the following description, appended claims, and accompanying drawings where:

FIGS. 5(*d*) illustrates the Wrist Watch user interface 350 provided with icon(s) indicating one or more set time alarms.

DETAIL DESCRIPTION OF THE PREFERRED EMBODIMENTS

Figure 1:
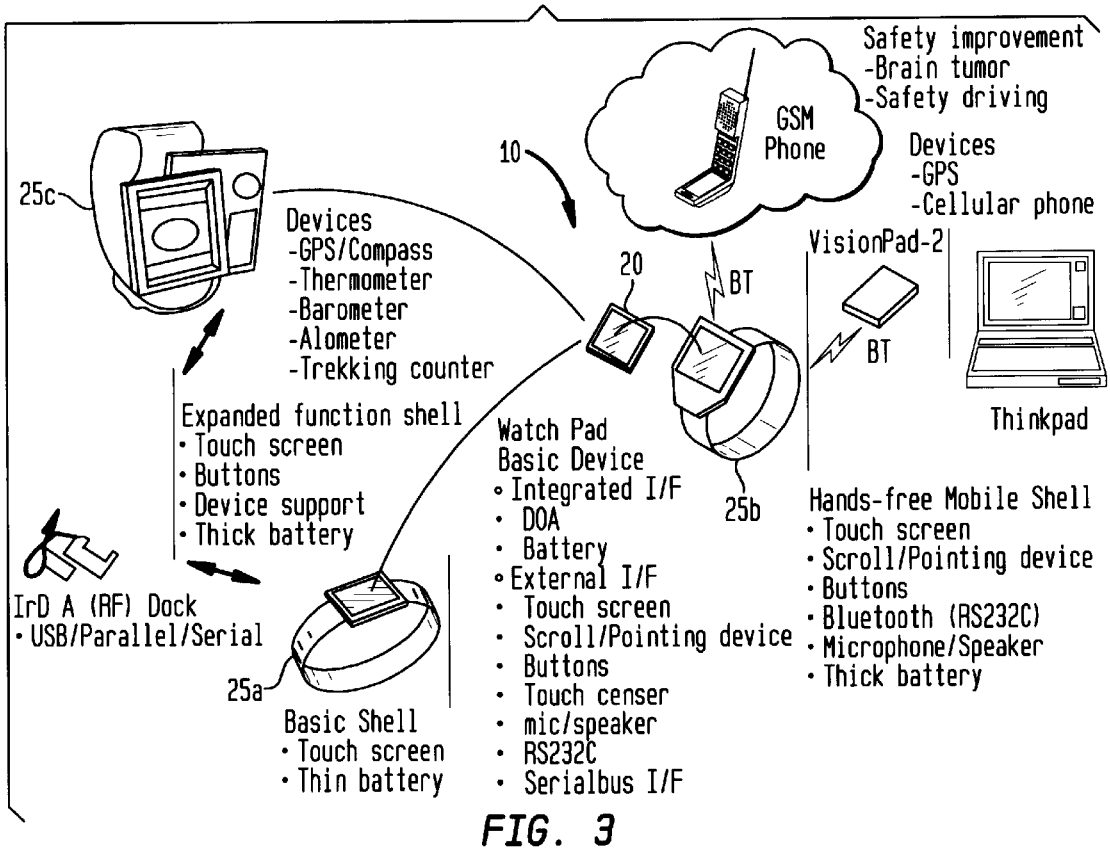
FIG. 1 illustrates conceptually the wearable information access wrist watch device of the invention.

FIG. 1 illustrates conceptually the wearable information access wrist watch device of the invention. Referred to herein as the "Wrist Watch" 10, the system looks like a regular watch but is capable of receiving information from adjunct devices such as a PC, a mobile computer, other pervasive devices being carried by the user and directly from a network via a wireless communications mechanism.

As shown in FIG. 1, the Wrist Watch system 10 is based on a modular concept designed to include a motherboard or base card 20 of minimum card size that leverages state-of-the-art technologies as will be described in greater detail herein. Specifically, the base card 20 may be implemented in various types of shells 25*a*, . . . , 25*c* for enabling various functions. For example, the base card 20 may be implemented in a basic shell 25*a* providing desktop like functionality via a touch screen display; a hands-free mobile shell 25*b* providing, in addition to basic desktop functionality, a communications interface with GPS and mobile phone communications capability etc., and including a touch screen display, scroll/pointing devices, and microphone and speaker devices; and an expanded function shell 25*c*, providing touch screen, buttons and support for various devices such as GPS/compass, thermometer, barometer, altimeter, etc.

Figure 2:
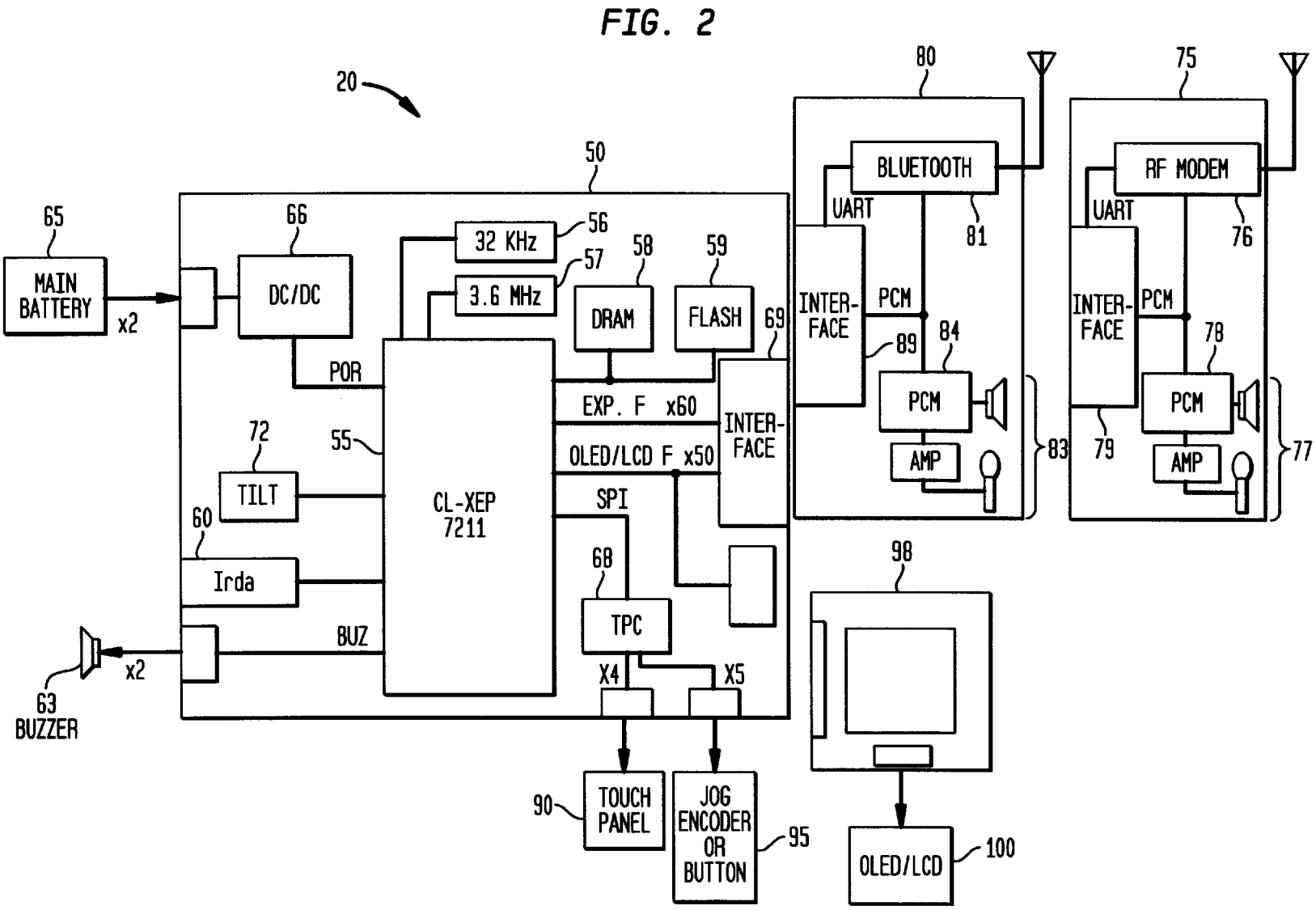
FIG. 2 is a detailed block diagram illustrating the hardware architecture of the Wrist Watch system 10.

FIG. 2 is a detailed block diagram illustrating the hardware architecture of the Wrist Watch system 10. As shown in FIG. 2, the base card 20 includes a first or main card 50 housing the core processing unit, I/O, and memory. For example the main card 50 includes a CPU 55, such as a Cirrus Logic CL-EP7211, which is a single-chip embedded controller functioning as a CPU for ultra-low-power applications, and armed with processing and enhanced memory management features to function equivalently as a 100 MHz Pentium. The core processing unit may operate at 2.5 V, and, to minimize the board size, may be equipped with a 3.68 MHz ceramic resonator 57 for generating the main frequency clock and timing signals, and a crystal-based clock circuit 56 for use in tracking real time. The main card 50 additionally includes sufficient nonvolatile and volatile memory including, for example, 64 Mbit EDO DRAM 58 and SRAM/Flash memory 59 that supports the system code. One communications subsystem of the Wrist Watch 10 includes a line of sight Infrared Data Association (IrDA) communications interface having a low-power IR transceiver module 60 mounted on the card 50 for direct connection with interface decoder pins of the CPU 55 which includes an IrDA SIR protocol encoder. The first card 50 additionally includes various Analog to Digital converters (ADC), memory refresh logic and industry standard interfaces such as a compact flash interface for example, so that other devices could be attached to the Wrist Watch 10. Other interfaces such as Universal Serial Bus (USB), and I2C, etc. may additionally be incorporated. FIG. 2 further illustrates the main card 50 as comprising the wheel generates a signal as a mouse device would when rolled. If a user rolls the wheel continuously, the wheel generates a signal for every 20 degrees of rotation (hereinafter "rotation event(s)"), with the event generated including an indication specifying whether the wheel was turned clockwise or anticlockwise. In this manner, the direction of the roller wheel, and consequently, the direction of cursor movement through a particular display, is tracked by the processor. The roller wheel mechanism additionally may be pushed or depressed to generate a signal (hereinafter "wheel click event(s)"), akin to a keypress or mouse click event, for activating a selected application, hyperlink or a menu item. In an alternate embodiment, the roller device may comprise a bezel which may be rotated and depressed for generating rotation and wheel click events respectively, such as described in commonly-owned co-pending U.S. patent application Ser. No. 09/607,594 entitled BEZEL BASED USER INTERFACE FOR A SMART WATCH, the whole contents and disclosure of which is incorporated by reference as if fully set forth herein. It is understood that other types of scroll device may be implemented to provide cursor movement, e.g., a slider. Moreover, a standard button may be implemented for providing selection functions.

With further reference to FIG. 2, the main card 50 has no audio capability but is equipped with a PCM audio interface in expansion tabs (not shown) for an accessory card, i.e., either card 75 or 80, in the expanded-shell Wrist Watch designs that support PCM audio. Particularly, the accessory card 75, 80 implemented includes a speaker and a microphone combination 77, 83 respectively, with the microphone functioning to record voice input which may be processed by the processor subsystem or stored in a storage subsystem for subsequent playback, and the speaker functioning to provide voice output, produce customized tones, and enable acoustic coupling with other listening devices, etc. As shown in FIG. 2, each speaker/microphone combination 77. 83 is connected to a respective pulse-coded modulation PCM coder/encoder devices (CODECs) 78, 84 which are controlled by a respective PCM interface 79, 89 to the CPU 55. The accessory card 75, 80 is additionally equipped with various communications subsystems including low power and intermediary power radio frequency communications devices that support a Wireless Application Protocol ("WAP") used to provide communications links to mobile computers, mobile phones, portable handheld devices and, connectivity to the Internet. In one embodiment, the specific communications subsystems include circuitry for supporting BlueTooth 81 or like small-factor, low-cost radio solution circuitry, e.g., an RF-modem 76, and may include other low power radio and Flex-paging communications circuits (not shown), etc. For instance, as shown in FIG. 2, the auxiliary communication card 80 implements the BlueTooth industry standard for Radio Frequency (RF) communication, however, it is understood that other standards such as IEEE 802.11 or other RF protocols may be implemented as well. Moreover, portions of these communication protocols may be implemented on the processor on the main board 50 so that the total number of the components required is minimized. The CPU system on the main card 50 preferably employs a first Universal Asynchronous Receiver Transmitter (UART1) device (not shown) for supporting either the RF-modem 76 or Bluetooth 81 communications functionality and, may be equipped with a second UART device (UART2) providing support for data download functionality, e.g., from a PC or network server. It is understood that any like data transfer mechanism or data exchange interface device may be implemented to provide data download and RF communications support functionality.

For purposes of interacting with the device, the Wrist Watch system 10 is provided with a touch sensitive screen/panel 90 shaped within a standard watch form factor, and also a roller wheel mechanism, i.e., jog encoder 95. The touch sensitive screen enables the direct launching of applications by physical user entry of a graffiti "squiggle" in the manner such as described in commonly-owned co-pending U.S. patent application Ser. No. 09/607,596 [YOR92000-0234, Atty. Docket No. 13577] entitled GRAFFITI BASED APPLICATION LAUNCH ON A SMART WATCH, the whole contents and disclosure of which is incorporated by reference as if fully set forth herein, and may initiate other applications/actions/events by physical touching of certain Wrist Watch display areas. In one embodiment, the touch sensitive screen panel is provided with a four (4) position touch screen. For instance, forward and back navigation for Wrist Watch displays is enabled by physically touching certain areas of the touch sensitive panel. The roller wheel mechanism 95 may be rolled up or down (i.e., clockwise or anticlockwise) to simulate a display cursor scrolling function for text and graphics. For example, in the context of the present invention, the roller wheel mechanism 95 generates signals that are A/D converted for receipt by the processor to enable movement of the Wrist Watch display cursor, and more particularly, movement of displayed minute hand and hour hand indicators for setting of various alarms and time-keeping functions provided by the Wrist Watch system. Preferably, when the wheel mechanism moves by more than a predetermined amount, e.g., 20° degrees, the wheel generates a signal as a mouse device would when rolled. If a user rolls the wheel continuously, the wheel generates a signal for every 20 degrees of rotation (hereinafter "rotation event(s)"), with the event generated including an indication specifying whether the wheel was turned clockwise or anticlockwise. In this manner, the direction of the roller wheel, and consequently, the direction of cursor movement through a particular display, is tracked by the processor. The roller wheel mechanism additionally may be pushed or depressed to generate a signal (hereinafter "wheel click event(s)"), akin to a keypress or mouse click event, for activating a selected application, hyperlink or a menu item. In an alternate embodiment, the roller device may comprise a bezel which may be rotated and depressed for generating rotation and wheel click events respectively, such as described in commonly-owned co-pending U.S. patent application Ser. No. 09/607,954 [YOR92000-0235, Atty. Docket No. 13578] entitled BEZEL BASED USER INTERFACE FOR A SMART WATCH, the whole contents and disclosure of which is incorporated by reference as if fully set forth herein. It is understood that other types of scroll device may be implemented to provide cursor movement, e.g., a slider. Moreover, a standard button may be implemented for providing selection functions.

As further shown in FIG. 2, various Analog to Digital converters (ADC) 68 support an interface with the touch screen display panel 90, and an interface with the jog encoder or button for the roller wheel mechanism 95. An interface 69 is provided for a unit 98 housing a high resolution (VGA equivalent) emissive Organic Light Emitting Diode (OLED) high contrast display 100. Further, the main card 50 for the basic shell interfaces to a buzzer 63 controlled directly by the CPU 55 using its buzzer interface and timer counters. To detect the posture of the watch, a mechanical four-way tilt sensor 72 is further provided comprising mechanical switches (for detecting degree of tilt) producing signals which may be detected by the CPU. This sensor may be used for the various purposes such as power management, display control, etc. In a preferred embodiment, additional sensors may be attached to the Wrist Watch device over an interface. Examples may include additional tilt and motion (velocity, direction, speed) sensors, environment sensors such as thermal sensors, pressure sensors, health monitoring sensors such as blood pressure, etc. The Wrist Watch accordingly provides the display for the sensor and may also analyze the data collected from the sensors.

With more particularity, the high contrast display 100 of FIG. 2 does not need a backlight to make the display visible. Thus, the power consumed by the display is proportional to the number of pixels that are turned on in the display. Since the pixels preferably comprise light emitting diodes, the display is automatically visible at night and a user does not need to press any buttons to see the display. Moreover, the OLED display 100 may be viewed clearly at a wide variety of angles with the brightness of these displays being controlled by limiting the amount of current supplied to the diodes. In one embodiment, the OLED chip 100 is a high-resolution pixel addressable display, e.g., 640×480, for enabling the display of various textual and graphical items on the watch face, similar to what may be displayed on a computer screen or a Palm Pilot®. For example, the time may be represented by drawing the hour and minute hands on a watchface display. Further, the hands of the watchface display may be erased when, at some other time, a display of a photograph is desired to be displayed.

Figure 3:
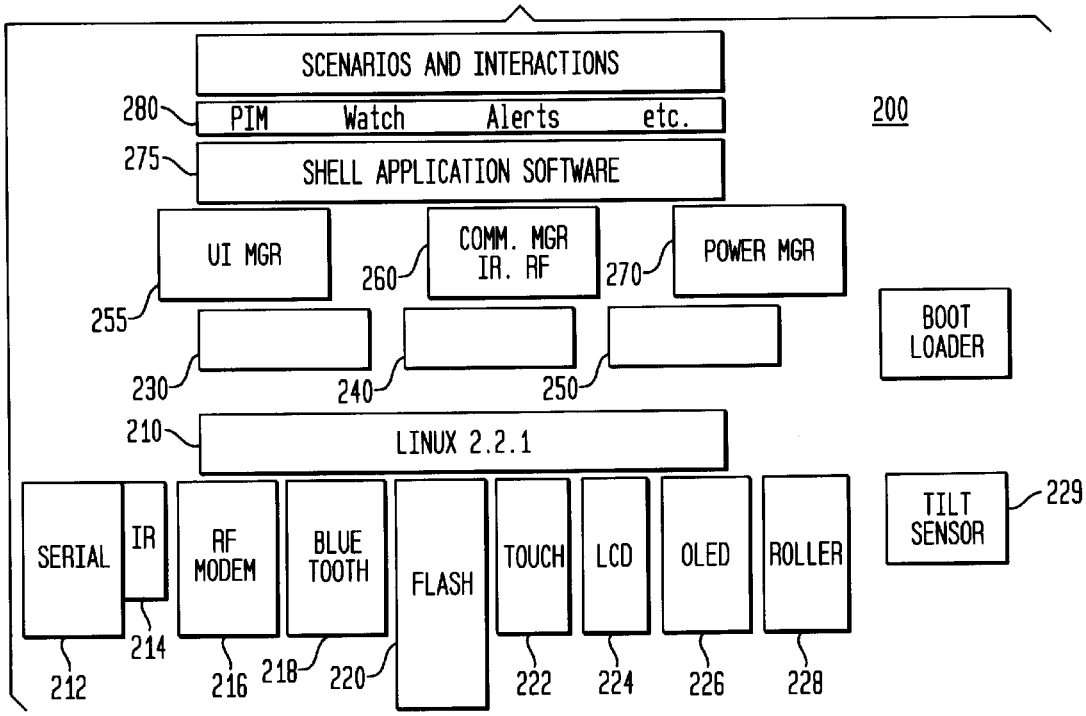
FIG. 3 illustrates the software architecture 200 for the Wrist Watch device 10.

FIG. 3 illustrates the software architecture 200 for the Wrist Watch device 10. At its lowest level, the Wrist Watch system runs an operating system 210, e.g., LINUX 2.2.1, that permits multiple user level and kernel level threads to run and will support multitasking and multi-user support. Device drivers are provided for each input/output subsystem will handle low level device dependent code and interfaces so that higher level Application Programming Interfaces (APIs) can be implemented on top of them. The device drivers provided for each input/output subsystem include a serial I/O system driver 212, IrDA system driver 214, RF-Modem subsystem driver 216, Bluetooth system driver 218, flash memory 220, touch screen subsystem driver 222, LCD subsystem driver 224, OLED subsystem driver 226, roller wheel subsystem driver 228 and tilt sensor device driver 229. A client-server graphics subsystem 230, storage subsystem manager 240 and synchronization sub-system manager 250 is provided on top of the device drivers for receiving and transmitting I/O events between the applications, updating of the screen, etc. A graphics library is available for the application writer so that custom screens may be displayed. A user interface manager 255 is provided to process events received from user input devices such as the roller wheel (jog encoder) and touch panel for the appropriate applications. A communication subsystem manager 260 is provided to handle events from communication channels and pass the events to the right application to set things up for data transfers to proceed. The synchronization manager 250 is provided to synchronize data between the Wrist Watch and the other devices. Particularly, it receives the data from the communication channel and operates in conjunction with the right application to decode the sent data and update the data for the application receiving the data. An example of this would be an update to a calendar event. A system wide power manager 270 is provided to monitor and control power consumption on the device and communicate with other subsystems such as the operating system scheduler to optimize the battery life of the device. The power manager 270, for example, measures the power left in the battery, estimates the power required to run an application, and recommends what subsystems need to be shut down as the battery starts draining out.

Figure 4:
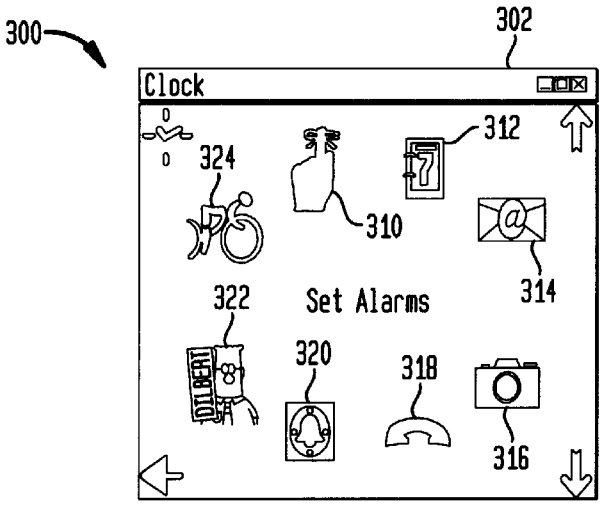
FIG. 4 illustrates an example system display 300 providing a main menu of selectable icons for launching Personal Information Management applications provided in the Wrist Watch device.
Figure 5A:
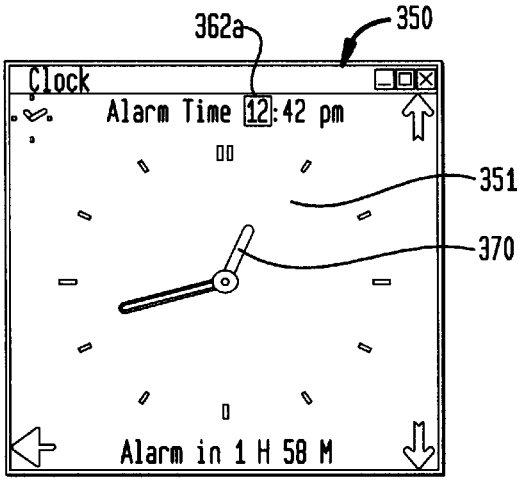
FIGS. 5(*a*) through 5(*c*) illustrate the Wrist Watch user interface 350 for performing alarm setting functions.
Figure 5B:
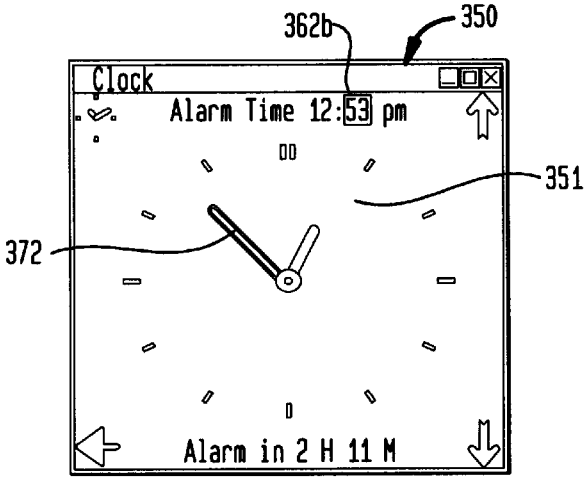
Figure 5C:
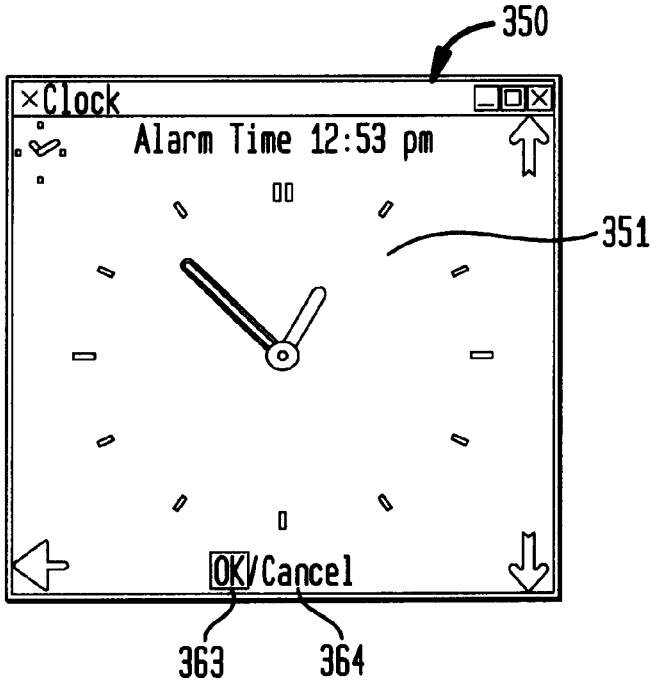
Figure 5D:
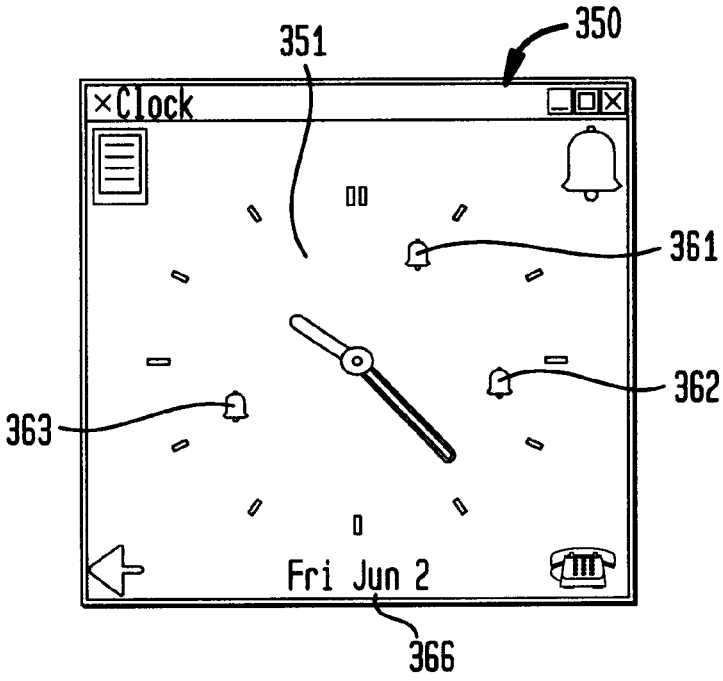

As further shown in FIG. 3, the Wrist Watch device 10 is equipped with Wrist Watch shell application software 275 provided on top of the basic graphics, communication and synchronization subsystems. One key application supported is the microbrowser which enables access to a WAP-supporting Web site and receives Web-based communications written in, for example, the Wireless Markup Language ("WML") using the XML standard. WML particularly is designed to optimize Internet text data for delivery over limited-bandwidth wireless networks and onto small device screens, and particularly, is devised to support navigation with limited input mechanisms, e.g., buttons. Details regarding the implementation of WML in the Wrist Watch device may be found in commonly-owned, co-pending U.S. patent application Ser. No. 09/608,042 entitled SYSTEM AND METHOD EMPLOYING WML ANNOTATIONS FOR USER INTERFACE CONTROL OF A WEARABLE APPLIANCE the contents and disclosure of which is incorporated by reference as if fully set forth herein. Other supported applications include Personal Information Management (PIM) applications software 280. FIG. 4 illustrates an example system display 300 providing a main menu 302 comprising selectable icons for launching the following PIM applications: an icon 310 for launching an application directed to displaying/maintaining "to do" lists, an icon 312 for launching an application directed to displaying/maintaining calendars and appointments, an icon 314 for launching an application directed to retrieving/storing/displaying e-mail messages, an icon 316 for launching an application directed to retrieving/storing/displaying digital photographs and bit-mapped images, an icon 318 for launching an application directed to retrieving/storing/displaying phone lists, an icon 322 for launching an application directed to retrieving/storing/displaying comic images such as Dilbert© United Feature Syndicate, Inc., an icon 324 for launching an application directed to providing stop watch and elapsed time features and, in accordance with the principles of the invention, an icon 320 for launching an application directed to setting of time and alarms which is shown highlighted and indicated by the displayed text "SET ALARMS". Other applications may include those enabling the receipt of excerpts of personalized data, such as traffic information, weather reports, school closings, stock reports, sports scores, etc., from the world wide web. These excerpts may be received as notifications or alarms on the Wrist Watch system 10. Inter-device interaction software applications are included to permit the watch display to become the display for another device such as a GPS located in a concealed location, (e.g., a bag), or a thermostat on the wall, etc. Thus, this application software enables communication between the other device and the Wrist Watch by receiving/displaying the data and transmitting back information sent from the Wrist Watch. As a further example, caller Id information may be displayed on the Wrist Watch display when the cell phone that belongs to that person rings. Typically, multiple persons are congregated in a room and carry their cell phones in a hand bag or wear them on their belts, have a hard time determining which cell phone is ringing when a ringing tone is heard in a room. This results in every person in the room pulling out his/her cell phone out of their handbag or belt to check if it is the one that is ringing. The caller Id display feature of the Wrist Watch device is particularly advantageous as each wearer may simply glance at the watch and would immediately know if the ringing phone belonged to him/her, in addition, to determining who the calling party is facilitating the decision of whether or not he/she should answer the phone. In a further example, this application software may allow the data from the Wrist Watch storage subsystem 240 to be viewed on another device such as on a PDA, PC, and other community viewing devices. In the preferred embodiment, middleware such as Tcl/Tk, Javascript, Perl, or the like etc., may run on top of the operating system, graphics and communication manager APIs for facilitating rapid development of these applications on the Wrist Watch device 10.

As discussed above, the Wrist Watch device 10 provides a user interface that facilitates the setting of time-keeping/alarm functions. One feature in particular enabled by the present invention is the facility by which a user may stop the alarm, select a snooze option where the user will receive subsequent reminders (i.e., the alarm to activate) after a predefined time interval, or cancel the alarm to prevent the generation of further reminders. When cancel is selected, either the alarm may be set at the same time again for the next day, or delete the alarm altogether.

FIGS. 5(*a*) and 5(*b*) illustrates a Wrist Watch user interface 350 providing an alarm setting display that enables a user to perform the task of setting the hour-hand and minute-hand indicators for time-keeping/alarm setting functions according to the principles of the invention. As shown in FIG. 5(*a*) and 5(*b*) the Wrist Watch comprises a watch face 351 having indicators 362*a*, 362*b* corresponding to hour hand 370 and minute hand 372, respectively, for setting an absolute alarm notification time in hours 362*a* (FIG. 5(*a*)) and minutes 362*b* (FIG. 5(*b*)) via control of the Wrist Watch scroll device. In accordance with the teachings of commonly-owned, co-pending U.S. patent application Ser. No. 09/607,801 entitled METHOD AND APPARATUS FOR DYNAMICALLY CONTROLLING SCROLLER SPEED EMPLOYED FOR A USER INTERFACE OF A WEARABLE APPLIANCE, the whole contents and disclosure of which is incorporated by reference as if fully set forth herein, the Wrist Watch scroll device (roller wheel) may be manipulated either clockwise or anti clockwise, generating either rotation events, or wheel click events to enable precise control for setting the alarm (watch hands 370, 372) to a particular value (for example, to 12:53 PM) without excessive roller wheel manipulation. FIG. 5(*c*) illustrates a Wrist Watch user interface display 350 providing a user selectable choice 363 for accepting the currently set alarm as illustrated in FIGS. 5(*a*) and 5(*b*), or canceling the selected alarm 364. FIG. 5(*d*) illustrates the resulting Wrist Watch display 350 showing an elliptical watch face 351 indicating the current time with the provision of an alarm indicating icon 361 provided at the scheduled alarm time (e.g., 12:53 PM as set by the user entry illustrated in FIGS. 5(*a*) and 5(*b*)) so that a user knows when the alarms are set. In accordance with the invention, several alarms may be set in the manner depicted in FIGS. 5(*a*)–5(*c*). Thus, in an example Wrist Watch display 350 of FIG. 5(*d*), several additional alarm icons 362 and 363 are illustrated as being set at various times. It is further possible to select a day in the future and set an alarm for that particular day.

According to the preferred embodiments of the invention, in addition to setting the time for the alarm, the user may optionally associate a message with the alarm by inputting a message via the various input mechanisms provided in the Wrist Watch device. When a message is associated with an alarm, the message will be displayed on the watch display when the alarm is activated so that the user is readily apprised of the message by glancing at the watch. This message may comprise a brief title or, optionally, longer more descriptive text associated with the set alarm indicated. For instance the title may indicate a meeting subject or purpose, while descriptive text may indicate the location, list of participants, etc. The Wrist Watch may receive text information associated with an alarm by manually entering a text string via a keypad or keyboard, or inputting a text string from an external source, e.g., the user's PC, implementing a known data exchange mechanism. For instance, an alarm actually may come from some other source, for example, the user's PC which maintains a list of appointments for the user with one of the appointments having an associated alarm indicating what the appointment was. Then, that information may be input to the Wrist Watch, such that the watch may subsequently activate the alarm at the programmed time, and accordingly indicate the associated text.

In the preferred embodiment, the user may set two types of alarms via the Wrist Watch interface—absolute alarms and relative alarms. Absolute alarms occur at a specified absolute time, e.g., at 12:53 PM and set in the manner as described with respect to FIGS. 5(*a*) and 5(*b*). Relative alarms are alarms that are activated at a specified interval from the time the alarm was set, for example, one (1) hour from now. When the user sets an alarm, the user specifies whether the alarms is an absolute or relative alarm by the manner in which they set the alarm: If the user designates an absolute time for the alarm on a given day, it is an absolute alarm, and if the user designates a relative time interval it is a relative alarm. As shown in an example Wrist Watch display 350 of FIG. 5(*d*), an absolute alarm 351 is illustrated as being set for the current indicated date 366.

Figure 6A:
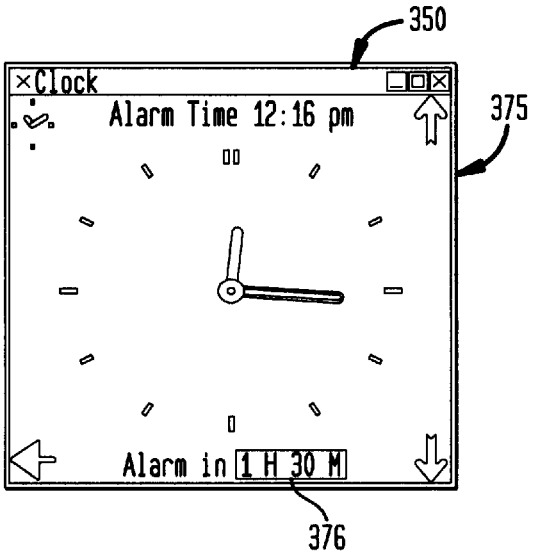
FIG. 6(*a*)–6(*b*), 6(*c*) illustrate an alarm setting display_ enabling the user to set a relative alarm via the Wrist Watch display.
Figure 6B:
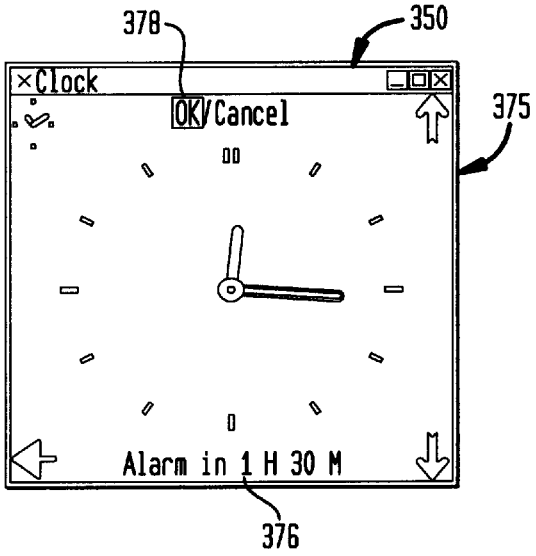
Figure 6C:
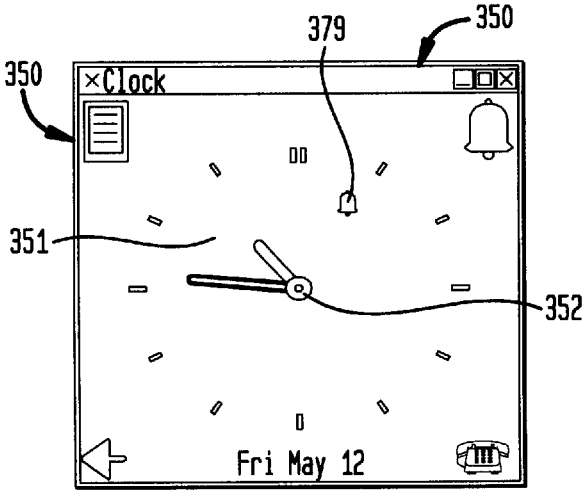

FIGS. 6(*a*)–6(*b*) illustrate an alarm setting display 375 enabling the user to set a relative alarm via the Wrist Watch display 350. For example, via the Wrist Watch roller wheel device, the relative notification time 376 in hours and minutes may be programmed as shown in FIG. 6(*a*). Specifically, this relative time is set relative to the current time. FIG. 6(*b*) illustrates the next sequence of Wrist Watch user interface display 375 providing a user selectable choice 378 for accepting or canceling the entered relative alarm notification time 376. FIG. 6(*c*) illustrates an example Wrist Watch user interface display 350 providing the indication of a relative alarm 379 set with respect to the current time 352 indicated on the Wrist Watch watch face display 351.

As a further feature, via the default Wrist Watch displays (FIGS. 5(*d*) and 6(*c*)) the user may enter a browsing mode enabling the user to look through each of the alarms by selecting an alarm icon, e.g. by clicking, via the scroll device, and then selectively modifying the alarm or deleting it.

Figure 7A:
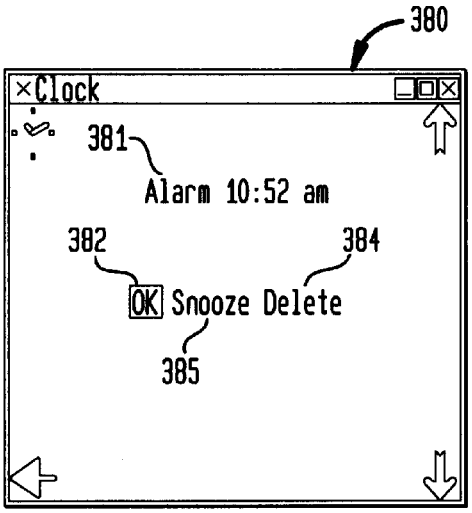
FIGS. 7(*a*)–7(*c*) illustrate alarm activation displays providing the user with an alarm notification and associated message text/links via the Wrist Watch display.
Figure 7B:
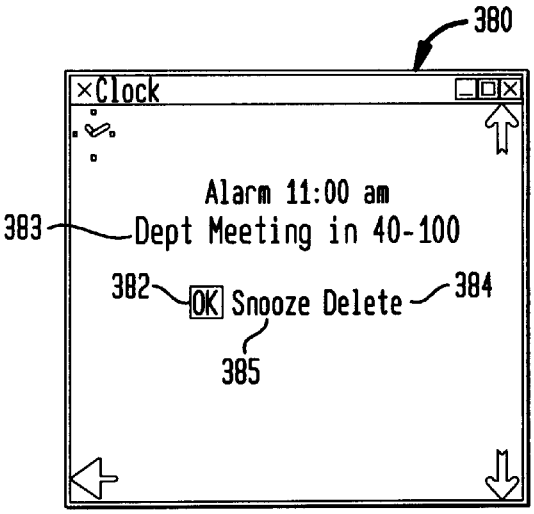
Figure 7C:
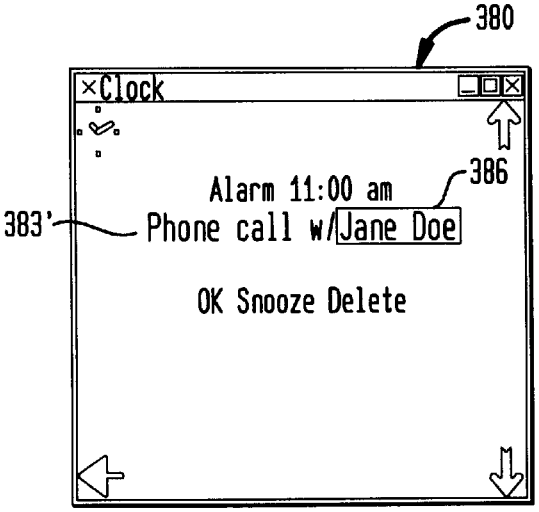

In the preferred embodiment, when an alarm is activated, an audible sound is generated. FIGS. 7(*a*) and 7(*b*) illustrate an example alarm event display 380 providing the user with an alarm notification via the Wrist Watch OLED display interface. Simultaneously with the audible alarm indication, an alarm indication 381 is displayed on the Wrist Watch alarm event display 380 as shown in FIG. 7(*a*). Additionally, if an associated message title or associated text was entered, that message and text 383 will additionally be displayed on the watch face at the time of alarm activation, as shown in FIG. 7(*b*). In a further embodiment, as depicted in FIG. 7(*c*), the displayed message title or associated text 383' may include a hyperlink 386, to another Wrist Watch application or display WML card formatted in the manner as described in commonly-owned, co-pendung U.S. patent application Ser. No. 09/608,042 [YOR92000-0224, Atty. Docket No. 13574] entitled SYSTEM AND METHOD EMPLOYING WML ANNOTATIONS FOR USER INTERFACE CONTROL OF A WEARABLE APPLIANCE the contents and disclosure of which is incorporated by reference as if fully set forth herein. In addition to the alarm message/title, icons or display indications for canceling the alarm 382, deleting the alarm 384 and placing the alarm in a snooze mode 385 may be presented on the alarm event display 380 as shown in FIGS. 7(*a*) and 7(*b*). The cancel option 383 may be highlighted as the default option when the alarm rings.

In the preferred embodiment, when the alarm is activated, the user may deactivate it, i.e., silence it, by touching or "tapping" once, any part of the touch sensitive display panel, or by rotating the roller wheel or by pressing in the roller wheel switch. Logic is programmed into the Wrist Watch device to silence the alarm in the first instance after activation upon detection of any user activity to the Wrist Watch interface the user provides. At such a time, the audible alarm will terminate and the display will continue to show the message title associated with the alarm, if any. After the alarm is silenced, another tap on the touch sensitive display within a short programmable interval, e.g., 10 seconds, activates the cancel option for canceling the alarm. That is, a "double-tap" by a user on the touch panel will automatically cancel the alarm. The alarm is canceled in a different manner depending upon what kind of alarm it was. For instance, if it was a relative alarm, then the alarm will be automatically reset for the same delta time, e.g., an hour, from the time it was originally set. If it is an absolute alarm, then the alarm will go off again the next day at the same time, if the double tap is hit. It is understood that, when the alarm is canceled, the message title associated with the alarm is also removed from the display screen. More specifically, if the alarm was an absolute alarm without an associated date 366, cancel enables the alarm to activate again at the same time, next day. If the absolute alarm had an associated date, cancel would get rid of the alarm altogether. In the display of FIGS. 7(*a*) and 7(*b*), in addition to icons for snooze and cancel, there is provided the delete icon. As before a single tap when the alarm is ringing silences the alarm. After this operation if the user controls the roller wheel to highlight delete and selects delete by clicking the wheel, the alarm is deleted. This operation would be performed by the user to get rid of a relative alarm or a date-less absolute alarm.

If the user does not tap the alarm a second time within a programmable time interval, the alarm message title disappears after this programmable interval of time and the alarm will be activated again after a programmable snooze interval, e.g., 5 minutes, again displaying the message title. If the user wishes to proactively put alarm to snooze, the user may move the roller wheel to highlight the snooze option 682 and then press the roller wheel switch. This action will put the alarm to snooze and remove the alarm message title from the screen. At this point, the watch screen will typically go back to a default display such as the watch face (e.g., FIG. 6(*d*)). If instead, the user wishes to view details about the alarm event, the user may move the highlight from the currently selected cancel option to the message title for the alarm and then press the roller switch. This action then gets the detailed description for the event. There may also be other icons on the screen that the user can select to launch other applications, e.g., switch the watch from daytime mode to night time mode or weekday mode to weekend mode, etc.

If the user does not interact with the watch at all when the alarm is activated, this may mean either: 1) the user did not hear the alarm although the watch is on the wrist, or 2) the watch is not on the user's wrist at all. The watch distinguishes these two cases by periodically monitoring the tilt sensor 72 (FIG. 2) on the watch. If the watch is on the user's wrist, then the alarm will automatically revert to the snooze setting after a preset time interval. If the watch is not on the wrist, the alarm will automatically be canceled after the preset interval.

Figure 8A:
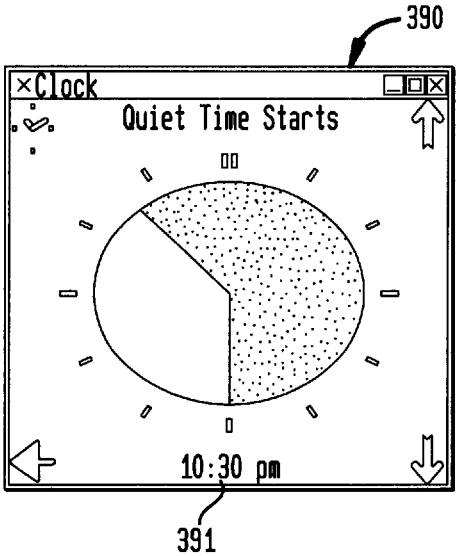
FIGS. 8(*a*)–8(*c*) illustrates an interface display for setting an absolute quiet time via the Wrist Watch OLED display.
Figure 8B:
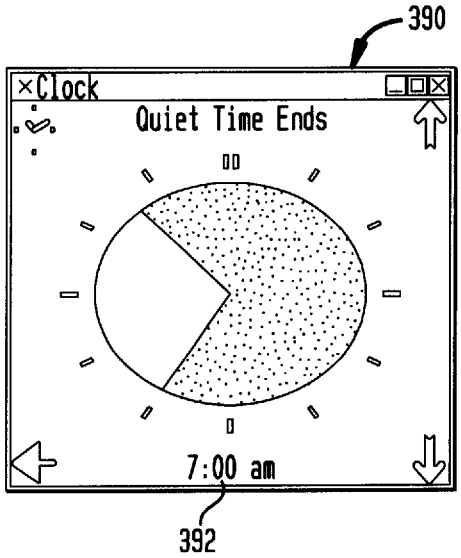
Figure 8C:
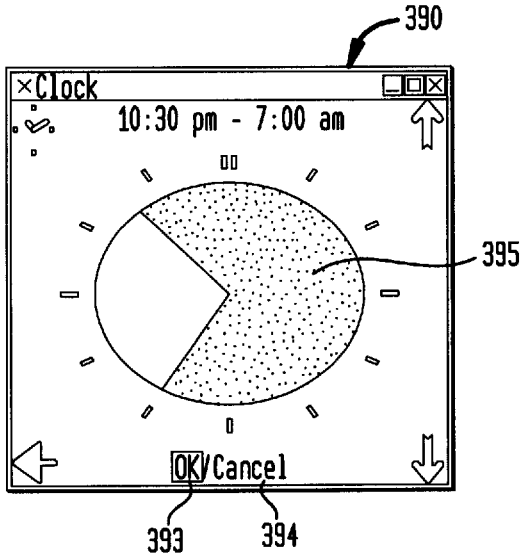

Another feature supported by the Wrist Watch time-keeping/alarm functionality is the concept of quiet time which is a user configurable time interval during which no audible alarms will ring. With respect to quiet time, both absolute and relative quiet times are supported with absolute quiet times being intervals that are set once and are applied on a daily basis, and relative quiet times being specified relative to the current time (e.g., from now until 1 hour from now). In each case, once the quiet time interval lapses the Wrist Watch returns to its normal mode where alarms produce audible tones. FIGS. 8(*a*)–8(*c*) illustrates a quiet time setting display 390 enabling the user to set an absolute quiet time via the Wrist Watch OLED display interface. One advantage of the absolute quiet time feature is to set up the alarm time configuration so that alarms do not sound for user programmable time intervals, e.g., when the wearer expects to have a restful sleep. Thus, in an example quiet time setting display interface shown in FIG. 8(*a*), the user may set the beginning of the quiet time 391, e.g., 10:30 P.M., at the time a user usually goes to bed, and in FIG. 8(*b*) sets the end of the quiet time interval 392, e.g., 7:00 A.M., at the time the user normally wakes up. FIG. 8(*c*) illustrates a Wrist Watch user interface display 390 providing a user selectable choice 393 for accepting the currently set quiet time interval 395 as illustrated in FIGS. 8(*a*) and 8(*b*), or canceling 394 the selected absolute quiet time interval.

Figure 9A:
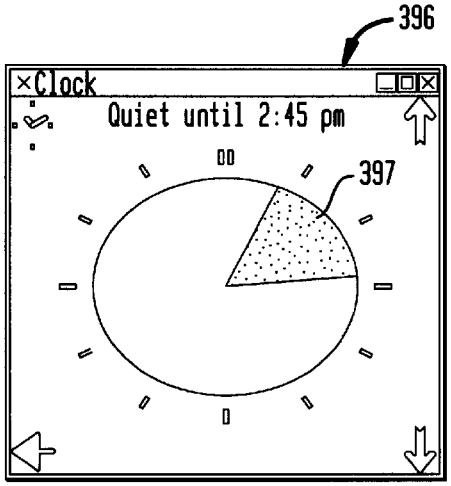
FIGS. 9(*a*)–9(*c*) illustrates an interface display for setting a relative quiet time via the Wrist Watch OLED display
Figure 9B:
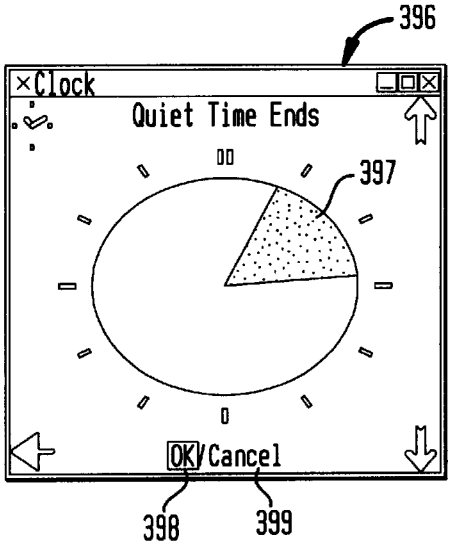
Figure 9C:
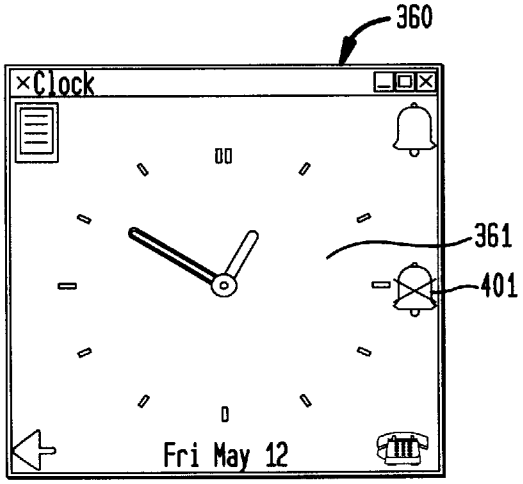

FIGS. 9(*a*)–9(*c*) illustrates an example quiet time setting display 396 enabling the user to set a relative quiet time via the Wrist Watch OLED display interface. One advantage of the relative quiet time feature is to set up the alarm time configuration so that alarms do not sound when the wearer expects to be at an important event like a meeting or a musical performance and wishes not to be disturbed. Thus, in an example quiet time setting interface shown in FIG. 9(*a*), the user may set the relative quiet time interval 397, at the time a user is about to go into a meeting or watch a movie, e.g., from a current time until 2:45 P.M. FIG. 9(*b*) illustrates a Wrist Watch user interface display providing a user selectable choice 398 for accepting the currently set quiet time interval 397 as illustrated in FIG. 9(*a*), or canceling the selected relative quiet time interval 399. FIG. 9(*c*) illustrates an example default Wrist Watch user interface display 360 showing a watch face 361 indicating the current time with the provision of an icon 401 indicating that a quiet time interval is currently set (e.g., one ending 2:45 P.M. as set by the user entry illustrated in FIGS. 9(*a*) and 9(*b*)) so that a user knows when the quiet time is set. The advantage of the relative quiet time is that the watch automatically resumes its normal mode of audible tones once the time is up. Otherwise, if the user turned off the alarm mode, the possibility exists that the user will forget to turn it back on. Thus, the user does not need to explicitly remember to re-set the alarm mode or re-enable audible tones. If the user desires to extend the relative quiet time interval, e.g., if the meeting or musical performance runs longer than expected, the user may do so by re-entering the relative quiet time setting mode of FIGS. 9(*a*) and 9(*b*).

As an extension of this quiet time feature, the Wrist Watch alarm setting feature is provided with functionality for setting priorities of quiet time versus the alarm. For instance a user may associate a relative priority value, e.g., a number with the alarms as well as quiet times. If the alarm priority is higher than the quiet time priority the alarm would produce an audible tone during a period of quiet time; otherwise, the alarm would remain silent. as described above. Using alarm priorities, e.g., 1, 2 and 3, and quiet time priorities 1 and 2 one may, for example, set an alarm at priority 3 which means that this alarm will always produce an audible tone regardless of the quiet time setting. Other alarms of priority 1 or 2 may be silenced by setting quiet time with priorities 1 or 2 respectively.

In another embodiment, the Wrist Watch time-keeping/alarm function may be provisioned with the ability to produce a silent alert such as a vibration, if an alarm is set for a particular time instant covered by a quiet time setting. In this instance, a watch will produce a silent alert with the herein-described functionality applicable for stopping the silent alert, e.g., a single tap on the touch sensitive screen, or, for canceling the set alarm, e.g., via a double tap, etc. If the watch does not have the ability to produce a silent alert, then the watch will simply display the alarm title on the screen without producing an audible alert, and automatically "cancel" the alarm. However, the screen will not revert to the clock face until the user taps on the screen. If another alarm were to occur during the quiet time, the title of the subsequent alarm will replace the title of the previous alarm. In other words, the title of the most recent alarm will be displayed on the watch face if the alarm occurred during a quiet time interval.

In another embodiment, the Wrist Watch device may be automatically have a quiet mode set, e.g., by provision of a wireless bluetooth beacon that periodically broadcasts information asking devices to be silent. For instance, at a public location where it is desired to have silence, e.g., a concert hall, a wireless transmitter may produce a beacon for turning off all sounds and/or switch the Wrist Watch device to a silent alert (vibrate) mode. Assuming the issue of standardization and authentication are solved, the Wrist Watch or any other portable device may receive these broadcasts and automatically configure themselves to be quiet. Once the device goes out of range of the beacon, it may automatically revert to its normal mode. Presumably, the beacon may transmit every minute asking the devices to be quiet for the next five minutes. If the watch did not receive the beacon transmission for five consecutive minutes, it then reverts to its normal mode. Beacons may also specify quiet time priorities making the entire process of setting quiet times automatic and non-intrusive to people carrying such devices. Important aspects of this feature include: 1) the watch does not have to transmit any acknowledgments; 2) the occasional loss of beacon transmissions is permitted; and, 3) the device may revert to its normal mode quickly after leaving the vicinity of the beacon.

It should be further understood that besides setting the alarm manually, in the manner as described herein, an alarm may be triggered by another agent, such as a remote RF transmitter (Bluetooth) or pager. Thus, for example, a server application for tracking or monitoring a set of conditions associated with events, such as sports scores, or user's stock prices, may be programmed to trigger an alarm for receipt by the wrist watch receiver device (FIG. 2). Thus, an audible alarm may be generated with a corresponding text message when that set of conditions is met, as determined by the remote application.

Figure 10:
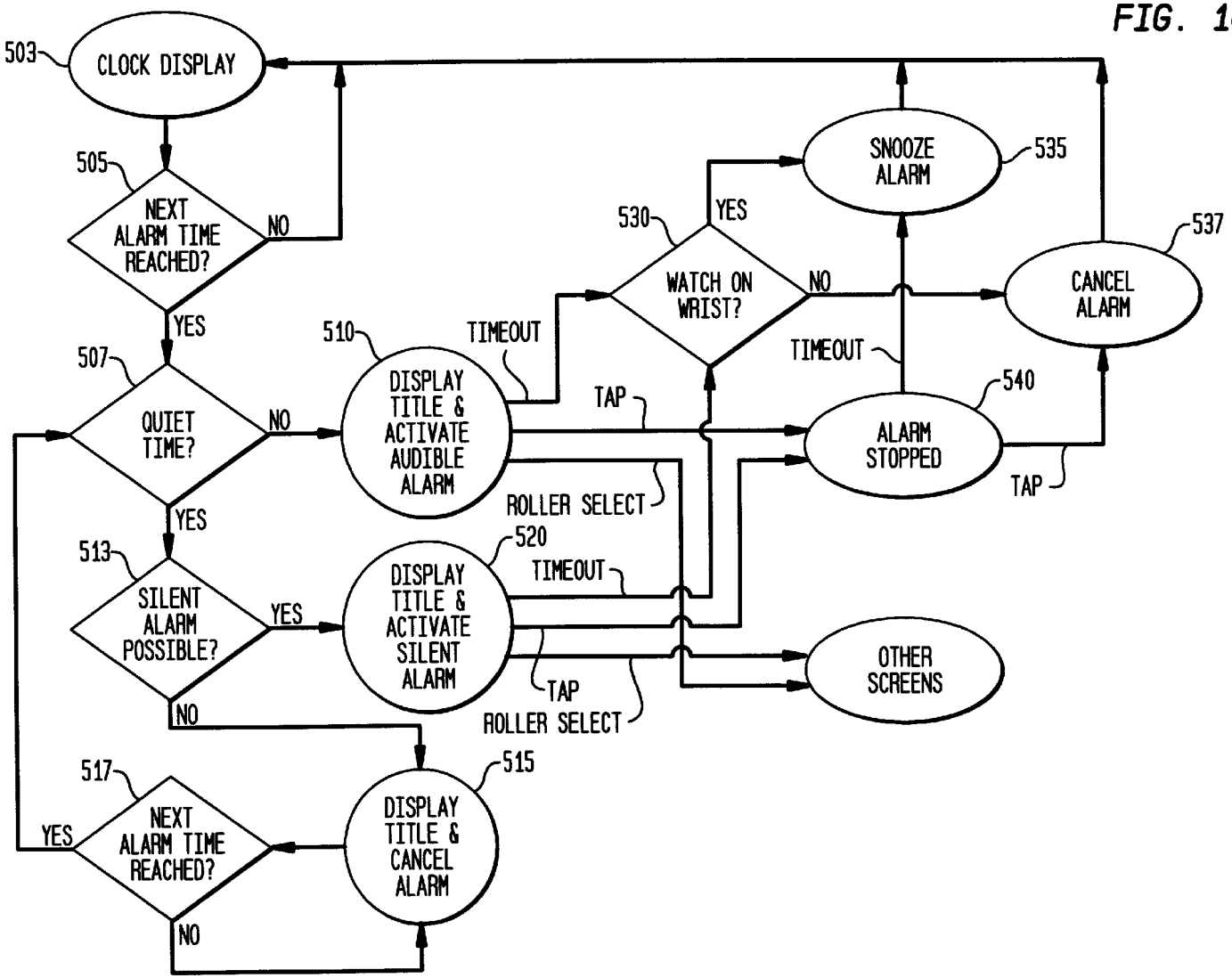
FIG. 10 is a flow chart depicting the functional alarm features according to the invention.

FIG. 10 is a flow chart depicting the time-keeping/alarm functions and methodology 500 programmed into the Wrist Watch device according to the invention. Block 503 depicts the default time-keeping/alarm Wrist Watch display interface (such as illustrated in FIG. 5(*d*)) to which all alarm functionality returns. At block 505, the software programmed into the graphics manager makes a decision as to whether the next set alarm time has been reached. If, the next set alarm time has not been reached, then the process returns to the default display. If, the next alarm time is reached, then, at block 507, a further determination is made as to whether the quiet time mode has been set. If the quiet time mode has not been set, then the audible alarm sound is generated and the title of the alarm message is displayed as indicated at block 510. Otherwise, if the quiet time mode has been set at block 507, then the process proceeds to block 513 to determine if the Wrist Watch is equipped with silent alarm capability. If the Wrist Watch is equipped with silent alarm function, then the silent alarm sound is activated and the title of the alarm message is displayed as indicated at block 520. Otherwise, if the Wrist Watch is not equipped with silent alarm function, then the process will proceed to block 515 to cancel the alarm and display the title/message of the alarm. The process then proceeds to block 517 where the determination is again made as to whether the next set alarm time has been reached. If the next set alarm time has been reached at block 517, then, at block 507, a further determination is made as to whether the quiet time mode has been set. At this point the methodology is repeated and continuously runs as herein described. If however, at block 517, it is determined that the next alarm time has not been reached, then the process continues to block 515 to wait until the next alarm time is reached. After either the audible or silent alarms have been activated at blocks 510 and 520, respectively, the system determines the user response, i.e., whether there was a single touch screen tap, a timeout, a roller wheel selection of another actions, e.g., cancel, set snooze, etc. Thus, for instance if the alarm has timed out indicating no user interaction, then a determination is made at block 530 to determine whether the watch is on the user's wrist, for example, by processing data from the tilt sensor (FIG. 2). If the tilt sensor indicates that it is possible the watch is on the wearer's wrist, then the system automatically sets a snooze alarm at block 535 and returns to the default clock display. Otherwise, if the tilt sensor indicates that the watch is not on the wearer's wrist, then the system cancels the alarm at block 537 and returns to the default clock display. If, the Wrist Watch touch sensitive panel detects a user tap, then at block 540, the system automatically stops the alarm. If, on the otherhand, the Wrist Watch system detects user roller wheel selection of an icon, or hyperlink, for example, then the system may take other action such as launching another application, generating a new WML card display and consequently will display related displays as indicated at block 545.

Thus, it is apparent from the described methodology the consistency and simplicity of actions the user needs to take to silence, snooze or view the details for the alarm. A single tap silences the alarm, a double tap cancels the alarm, a single tap and time-out "snoozes" the alarm. Single or double taps on the watch face do not require the user to even look at the watch and may be done while doing other things such as engaging in a conversation, reading a newspaper or whatever. Using a tap followed by scroll highlight and select may launch other actions, but in this case the user needs to pay more attention to the watch, i.e., look at it. Still if the list of possible options is small, the amount of user distraction is minimal.

While the invention has been particularly shown and described with respect to illustrative and preformed embodiments thereof, it will be understood by those skilled in the art that the foregoing and other changes in form and details may be made therein without departing from the spirit and scope of the invention which should be limited only by the scope of the appended claims.

Having thus described our invention, what we claim as new, and desire to secure by Letters Patent is:

1. A method for efficiently activating and deactivating alarm functions via a user interface provided in a wearable appliance having a display for displaying textual or graphical content, said display including a touch sensitive panel for detecting physical user interaction, said method comprising:

a) setting a time for an alarm via minute and hour display indicators in response to receipt of scroll events generated by manipulating a scroll device provided on said wearable appliance, said alarm capable of being activated to provide user alarm indication at a set time, said alarm comprising one of: an absolute alarm for activation at a daily frequency, and, a relative alarm for activation at a predefined time relative to a current time;

b) determining a time setting of a next set alarm and providing an alarm indication at said set time;

c) detecting a first user interaction with said touch sensitive panel to deactivate said alarm indication; and d) detecting a second user interaction with said touch sensitive panel within a pre-determined time interval of said first user interaction, said second user interaction proactively enabling one of: setting of a snooze alarm interval, automatic cancellation of said alarm, and, automatic re-setting of said alarm for a next day, whereby minimal user interaction is required to control alarm functions.

2. The method as claimed in claim 1, wherein said second user interaction comprises manipulating said scroll device.

3. The method as claimed in claim 1, wherein said step c) further includes the step detecting absence of any further user interaction with said touch sensitive panel within a pre-determined time interval, and in response, enabling automatic re-activaton of said alarm at a programmable snooze time interval.

4. The method as claimed in claim 3, further including the step of: periodically monitoring a tilt sensor provided in said wearable appliance for determining disposition of said appliance relative to said user, wherein in response to detection of absence of any further manipulation of said touch sensitive panel within a pre-determined time interval, the step of automatically reverting to a programmable snooze setting after said if said appliance is disposed on said user, or automatically canceling said alarm if said appliance is detached from said user.

5. The method as claimed in claim 1, wherein said step a) further includes the step of inputting a text message for association with a set alarm, said activating of said set alarm at said set time including simultaneously displaying said associated text message via said user interface.

6. The method as claimed in claim 5, wherein said text message includes a hyperlink.

7. The method as claimed in claim 1, wherein said step a) includes setting of a plurality of alarms via said interface, said method further including the steps of:

displaying a watch face display having hour-hand and minute hand indicator mechanisms via said user interface; and, generating an icon representing each of said plurality of set alarms and displaying each icon on said user interface display to indicate for said user said set alarm times.

8. The method as claimed in claim 7, further including the step of manipulating said scroll device to select an icon for enabling display of a detailed text message associated with a set alarm.

9. The method as claimed in claim 1, further including the step of setting a quiet alarm interval in response to scroll events generated by manipulating a scroll device, said quiet alarm interval defining an interval of time in which a set time alarm is to be deactivated, said step b) of determining a time setting of a next alarm further including determining if said set time is within a set quite time interval.

10. The method as claimed in claim 9, wherein said quiet alarm interval comprises one of an absolute quiet time interval and a relative quiet time interval, said absolute quiet time interval being set to activate at a daily frequency, said relative quiet time interval being activated for a predefined time period relative to a current time.

11. The method as claimed in claim 9, further including the step of:

displaying a watch face display having hour-hand and minute hand indicator mechanisms via said user interface; and, generating an icon representing a set quiet time interval and displaying said icon on said user interface display to indicate for said user said set quiet time interval.

12. The method as claimed in claim 1, wherein said setting of an alarm includes receiving coarse-grain and fine-grain alarm set commands in response to scroll events generated by manipulating a scroll device, said fine-grain setting of said alarm corresponding to one (1) minute increment per scroll device event.

13. The method as claimed in claim 12, wherein said course-grain setting of said alarm corresponds to greater than one minute increments per scroll event.

14. The method as claimed in claim 1, wherein said alarm indication includes one of an audible alarm and a silent alarm.

15. A system for efficiently activating and deactivating alarm functions via a user interface provided in a wearable appliance having a display for displaying textual or graphical content, said system comprising:

a scroll device for manipulation by a user, to provide scrolling functions enabling setting of an alarm via minute and hour display indicators provided on said wearable appliance display, said scroll device generating scroll events and click events for setting said alarm, said alarm capable of being activated to provide user alarm indication at a set time, said alarm comprising one of: an absolute alarm for activation at a daily frequency, and, a relative alarm for activation at a predefined time relative to a current time;

a time-keeping mechanism for independently tracking said current time;

a touch sensitive panel for receiving user interactions; and, a control mechanism for determining a time setting of a next alarm and providing an alarm indication at said set time, said control mechanism further interfaced with said touch sensitive panel for detecting a first user interaction with said touch sensitive panel to deactivate said alarm indication, and detecting a second user interaction with said touch sensitive panel within a pre-determined time interval of said first user interaction, said second user interaction proactively enabling one of: setting of a snooze alarm interval, automatic cancellation of said alarm, and, automatic re-setting of said alarm for a next day, whereby minimal user interaction is required to control alarm functions.

16. The system as claimed in claim 15, wherein said control mechanism further detects absence of any further user interaction with said touch sensitive panel within a pre-determined time interval, and in response, enables automatic re-activation of said alarm at a programmable snooze time interval.

17. The system as claimed in claim 16, further comprising:

a tilt sensor provided in said wearable appliance for determining disposition of said appliance relative to said user, said control mechanism periodically monitoring said tilt sensor whereby, in response to detection of absence of any further user interaction with said touch sensitive panel within a pre-determined time interval, said control mechanism performing one of: automatically reverting to a programmable snooze time setting if said appliance is disposed on said user, or automatically canceling said alarm if said appliance is detached from said user.

18. The system as claimed in claim 15, further including mechanism for inputting a text message to be associated with a set alarm, and memory storage device for storing said associated text message, said alarm indication including display of said associated text message via said user interface.

19. The system as claimed in claim 18, wherein said text message includes a hyperlink.

20. The system as claimed in claim 18, wherein said scroll device is manipulated by a user for setting a plurality of alarms via said interface, said user interface including a watchface display having hour-hand and minute hand display indicators; said system further comprising:

mechanism for generating an icon representing each of said plurality of set alarms and displaying each icon on said user interface display to indicate for said user said set alarm times.

21. The system as claimed in claim 20, wherein said scroll device is manipulated by a user for selecting a displayed icon, said control mechanism in response enabling display of a detailed text message associated with a set alarm.

22. The system as claimed in claim 15, further including mechanism for setting of a quiet alarm interval defining an interval of time in which a set time alarm is to be deactivated, said control mechanism further determining if a time setting of a next alarm is within a set quite time interval.

23. The system as claimed in claim 22, wherein said quiet alarm interval comprises one of an absolute quiet time interval and a relative quiet time interval, said absolute quiet time interval being set to activate at a daily frequency, said relative quiet time interval being activated for a predefined time period relative to a current time.

24. The system as claimed in claim 22, further including mechanism for transmitting a signal in a pre-determined area including users possessing said wearable appliance, said wearable appliance including device for receiving said transmitted signal and automatically initiating a quiet time setting for each user in said area for a pre-determined time interval.

25. The system as claimed in claim 15, further including mechanism for providing fine-grain and course-grain setting of alarms in response to scroll events generated by manipulating said scroll device, said fine-grain setting of said alarm corresponds to one (1) minute increment per scroll device scroll event.

26. The system as claimed in claim 25, wherein-said course-grain setting of said alarm corresponds to greater than one minute increments per scroll event.

27. The system as claimed in claim 15, wherein said control mechanism receives said click events for entering setting or canceling of an alarm.

28. The system as claimed in claim 15, wherein said alarm indication includes one of an audible alarm and a silent alarm.

29. A program storage device readable by a machine, tangibly embodying a program of instructions executable by the machine to perform method steps for efficiently activating and deactivating alarm functions via a user interface provided in a wearable appliance having a display for displaying textual or graphical content, said display including a touch sensitive panel for detecting physical user interaction, said method comprising:

a) setting a time for an alarm via minute and hour display indicators in response to receipt of scroll events generated by manipulating a scroll device provided on said wearable appliance, said alarm capable of being activated to provide user alarm indication at a set time, said alarm comprising one of: an absolute alarm for activation at a daily frequency, and, a relative alarm for activation at a predefined time relative to a current time;

b) determining a time setting of a next set alarm and providing an alarm indication at said set time;

c) detecting a first user interaction with said touch sensitive panel to deactivate said alarm indication; and d) detecting a second user interaction with said touch sensitive panel within a pre-determined time interval of said first user interaction, said second user interaction proactively enabling one of: setting of a snooze alarm interval, automatic cancellation of said alarm, and, automatic re-setting of said alarm for a next day, whereby minimal user interaction is required to control alarm functions.

30. The program storage device readable by a machine as claimed in claim 29, wherein said method step c) further includes the step detecting absence of any further user interaction with said touch sensitive panel within a pre-determined time interval, and in response, enabling automatic re-activation of said alarm at a programmable snooze time interval.

31. The program storage device readable by a machine as claimed in claim 30, wherein said method further includes the step of: periodically monitoring a tilt sensor provided in said wearable appliance for determining disposition of said appliance relative to said user, wherein in response to detection of absence of any further manipulation of said touch sensitive panel within a pre-determined time interval, the step of automatically reverting to a programmable snooze setting after said if said appliance is disposed on said user, or automatically canceling said alarm if said appliance is detached from said user.

32. The program storage device readable by a machine as claimed in claim 29, wherein said method step a) further includes the step of inputting a text message for association with a set alarm, said step of providing an alarm indication at said set time including simultaneously displaying said associated text message via said user interface.

33. The program storage device readable by a machine as claimed in claim 29, wherein said method further includes the step of setting a quiet alarm interval in response to scroll events generated by manipulating a scroll device, said quiet alarm interval defining an interval of time in which a set time alarm is to be deactivated, said step b) of determining a time setting of a next alarm further including determining if said set time is within a set quite time interval.

34. The program storage device readable by a machine as claimed in claim 33, wherein said quiet alarm interval comprises one of an absolute quiet time interval and a relative quiet time interval, said absolute quiet time interval being set to activate at a daily frequency, said relative quiet time-interval being activated for a predefined time period relative to a current time.

35. A method for efficiently activating and deactivating alarm functions via a user interface provided in a wearable appliance providing with a real-time keeping function, and having a display for displaying textual or graphical content, said method comprising:

a) setting a time for an alarm via minute and hour display indicators in response to receipt of scroll events generated by manipulating a scroll device provided on said wrist watch, said alarm capable of being automatically activated to provide user alarm indication at a set time;

b) setting a relative quiet alarm interval in response to scroll events generated by manipulating said scroll device, said quiet alarm interval defining an interval of time from a current time wherein alarms are prevented from being sounded; and, c) at said alarm set time, determining if said set alarm time is within said relative quiet alarm interval, and preventing user alarm indication at said set time if said set alarm time is within said relative quiet alarm interval.

36. A system for efficiently activating and deactivating alarm functions via a user interface provided in a wearable appliance having a display for displaying textual or graphical content, said system comprising:

a scroll device for manipulation by a user to provide scrolling functions enabling setting of an alarm via minute and hour hand display indicators provided on said wrist watch display, said scroll device generating scroll events and click events for setting said alarm, said alarm capable of being activated to provide user alarm indication at a set time;

a time-keeping mechanism for independently tracking said current time;

means responsive to scroll events generated by manipulating said scroll device for setting a relative quiet alarm interval, said relative quiet alarm interval defining an interval of time from a current time wherein alarms are prevented from being sounded; and, a control mechanism interfaced with said time keeping mechanism for determining if a set alarm time is within said relative quiet alarm interval, and said control mechanism further preventing user alarm indication at said set alarm time if said set alarm time is within said relative quiet alarm interval.

* * * * *